United States Patent [19]

Foy

[11] Patent Number: 4,573,400

[45] Date of Patent: Mar. 4, 1986

[54] INSULATED CHIMNEY PIPES

[75] Inventor: Martin Foy, Cridwell, England

[73] Assignees: Morganite Ceramic Fibres Limited, Merseyside, England; Insulated Chimneys (Trim) Limited, Dublin, Ireland; a part interest

[21] Appl. No.: 514,859

[22] Filed: Jul. 19, 1983

Related U.S. Application Data

[63] Continuation of Ser. No. 215,656, Dec. 12, 1980, abandoned.

[30] Foreign Application Priority Data

Apr. 16, 1980 [GB] United Kingdom ..... 8012578

[51] Int. Cl.[4] ..... E04F 17/02

[52] U.S. Cl. ..... 98/60; 52/249; 52/726; 110/184; 138/148; 138/149; 138/155

[58] Field of Search ..... 52/726, 727, 593, 218, 52/219, 245, 249, 404; 98/58, 60; 110/184; 126/307 R; 138/148, 149, 155

[56] References Cited

U.S. PATENT DOCUMENTS

| | | | |
|---|---|---|---|
| 285,112 | 9/1883 | Clawson | 52/249 |
| 425,601 | 4/1890 | Eversman et al. | 138/148 X |
| 2,101,270 | 12/1937 | Rice | 110/184 X |
| 2,120,309 | 6/1938 | Carson | 110/184 X |
| 2,759,491 | 8/1956 | Everhart | 138/148 X |
| 3,628,572 | 12/1971 | Shannon | 138/149 X |
| 3,754,948 | 8/1973 | Ash | 138/149 X |
| 3,768,523 | 10/1973 | Schroeder | 138/149 X |
| 3,891,009 | 6/1975 | Noda et al. | 138/149 |
| 3,958,582 | 5/1976 | Noda et al. | 138/149 |

FOREIGN PATENT DOCUMENTS

| | | | |
|---|---|---|---|
| 555176 | 8/1943 | United Kingdom | 138/148 |
| 894056 | 4/1962 | United Kingdom . | |
| 1032469 | 6/1966 | United Kingdom | 110/184 |
| 1506152 | 4/1978 | United Kingdom . | |

OTHER PUBLICATIONS

Fiberwall Leaflet (Typical Design and Constructions Details); Carborundum.

Fiberwall Installation Manual; Carborundum, Jan. 1979.

*Primary Examiner*—Harold Joyce

*Attorney, Agent, or Firm*—William R. Hinds

[57] ABSTRACT

An insulated chimney pipe for use with boilers or open fires has a plurality of sections comprising an outer wall of galvanized steel connected by two end caps to an inner wall formed of a refractory material comprising alumino-silicate fibres bonded together with an inorganic colloidal bonding agent.

8 Claims, 4 Drawing Figures

INSULATED CHIMNEY PIPES

This application is a continuation of application Ser. No. 215,656, filed Dec. 12, 1980, now abandoned.

BACKGROUND OF THE INVENTION

The present invention relates to insulated chimney pipes of the type that are commonly used to conduct hot waste gases from a domestic sold fuel burner, oil or gas central heating boiler or the like to the atmosphere in place of traditional brick chimneys.

Such chimney pipes must satisfy stringent British Standards tests administered by the Agrément Board to ensure that they satisfy requirements as to ease of installation and access, adequate service life and low thermal conductivity. Chimney pipes frequently pass through floors and lofts and may thus pass very close to combustible material. It is therefore important that the external temperature of chimney pipes can not rise above a predetermined level, and in order to satisfy the relevant British Standard on this criterion most insulated chimney pipes are of a double wall construction. The inner wall is invariably of stainless steel whilst the outer wall may be of galvanised or vinyl coated steel and spaced from the inner wall by a layer, typically about 40 mm thick, of thermally insulating material such as mineral wool, fire-clay or rock granules. However, for chimneys of a larger diameter even a double wall construction may not be adequate. Thus a 200 mm diameter chimney for use with open fires must satisfy British Standard No. 4543, and in order to fulfil the thermal conductivity criterion it has been found necessary to make this chimney of a three wall construction, which is naturally extremely expensive.

Such conventional two or three wall chimneys with a stainless steel inner wall are intended to have a service life of about 20 years. In practice this service life is not always achieved because of the highly corrosive atmosphere to which the stainless steel is exposed. In particular the action of water formed by condensation and sulphuric acid formed by the combination of this water with sulphur containing gases liberated by the combustion of sulphur containing fuel oils or the like together with the cumulative corrosive effect of thermal shock or stress can lead to a substantial reduction in the service life and in extreme cases the total collapse of the stainless steel wall. The recent increase in the burning of wood in domestic boilers and open fires has exacerbated these problems since the combustion of wood produces wood acids and other particularly corrosive substances which over time attack and ultimately destroy the stainless steel inner wall of the lining.

SUMMARY OF THE INVENTION

According to the present invention there is provided an insulated chimney pipe for use with boilers, open fires or the like comprising an outer wall within and spaced from which is an inner refractory wall comprising bonded aluminosilicate fibres and an end cap at each end of the chimney pipe, the inner wall being of one-piece moulded construction and the end caps engaging the inner and outer walls and maintaining a predetermined spacing between them. The thermal conductivity of such refractory material can be very low indeed, and whilst this will vary with temperature is preferably between 0.01 and 0.3 W/mK, e.g. between 0.03 and 0.2 and preferably between 0.04 and 0.06 W/mK at 200° C.

The outer wall, which may be of conventional type, e.g. of galvanised or vinyl covered steel, is preferably spaced from the inner wall whose width is preferably between 6 and 30 mm by a gap whose width is preferably between 6 and 30 mm which may be filled with air or with an insulating material such as rock wool or an aluminosilicate fibre blanket. The gap therefore preferably contains at least a proportion of air and contributes substantially to the insulating qualities of the chimney pipe but in addition there is preferably air within the refractory material. This not only enhances the insulating qualities of the refractory material but also reduces its weight without adversely affecting its strength. Preferably the density of the refractory material is between 100 and 600 and more particularly between 200 and 400 $Kg/m^3$.

In the most preferred embodiment of the invention the alumino-silicate ceramic fibres have a specific gravity of between 1 and 5, more particularly 2 to 4 and a fibre diameter of between 1 and 10$\mu$ and more preferably 5 and 10$\mu$. The fibres are bonded together by an inorganic bonding agent, such as alumina or silica and the composition of the material will vary according to the required refractoriness but is preferably between 30 and 80% by weight $Al_2O_3$ and 70 and 20% $SiO_2$ together with minor proportions of various inorganic constituents. In the preferred embodiment the material contains between 30 and 40% alumina and between 70 and 60% silica.

Such fibres are manufactured by heating alumina and silica in the desired proportions to a temperature of about 2000° C. to melt them and then blowing or spinning the melt to form the fibres. After cooling, a colloidal inorganic bonding agent is added to the fibres to form an aqueous slurry. A suitable bonding agent is that sold by Monsanto under the Trade Mark SYTON which is colloidal silica. If desired an organic stabilising agent, such as starch, may be added to the slurry to stabilise the silica. The inner wall of the chimney pipe is then moulded and subsequently dried. Conveniently the moulding process comprises a vacuum moulding process in which a permeable hollow mandrel whose interior is under a vacuum is placed in the slurry to form the inner wall of the pipe which is then slid off again prior to drying.

A pipe formed of such alumino silicate fibres is extremely refractive and capable of operating indefinitely at a temperature of between 1200° and 1600° C., depending on the proportion of alumina. It has a high resistance to thermal shock, largely due to the fact that its coefficient of expansion is effectively zero and extremely low thermal conductivity. Its thermal conductivity is in fact about one third of that of rock wool and about one tenth that of fire brick. Chemically it is inert, except to strong alkalis and to hydrofluoric and like strong acids, and it is unaffected by steam, oil or water. It is not subject to cracking or shrinkage and is extremely dimensionally stable.

All these characteristics are ideal for the inner wall of a double-walled chimney, and a chimney incorporating an inner wall of alumino-silicate fibres will have a dramatically increased service life, i.e. of the order of 60 years which is the same as the anticipated life of most modern houses. In addition, by virtue of the superior mechanical and thermal properties of alumino-silicate fibres the chimney in accordance with the invention is able to satisfy British Standard No. 4543 referred to above in a double wall construction, without the need to use a third wall.

A domestic chimney pipe in accordance with the invention preferably comprises two or more interconnected sections. Each end of each section, with the exception of the upper end of the upper section and the lower end of the lower section are preferably of either male or female configuration to engage the end of an adjacent section. The inner and outer walls of each section are preferably connected by a end cap which may be of metal or bonded aluminosilicate fibres which affords the male of female profile.

Further features and details of the invention will be apparent from the following description of two specific embodiments which is given by way of example only with reference to the accompanying diagrammatic drawings.

DESCRIPTION OF THE PREFERRED EMBODIMENTS

Figure 1:
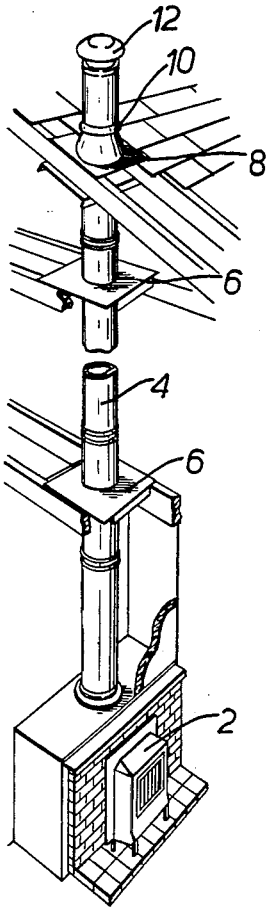
FIG. 1 is a perspective view of a domestic fire having a multisection chimney in accordance with the invention.

FIG. 1 shows a domestic coal burning fire 2 having a chimney in accordance with the invention comprising a number of interconnected sections 4. The chimney is shown as passing through two floors, where it is retained in position by a conventional fire stop 6, and through the roof of the house where it is provided with a conventional flashing 8 and storm collar 10 and is capped by a terminal cap 12.

Figure 2:
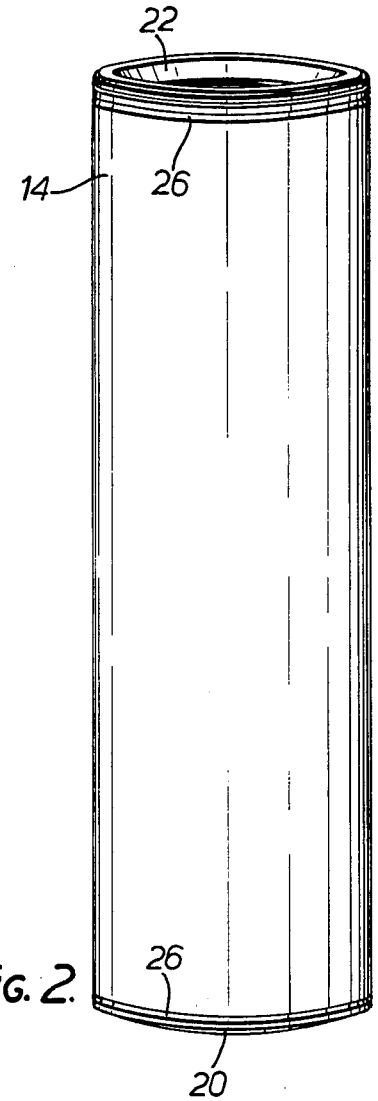
FIG. 2 is an enlarged side elevation of one section of the chimney.
Figure 3:
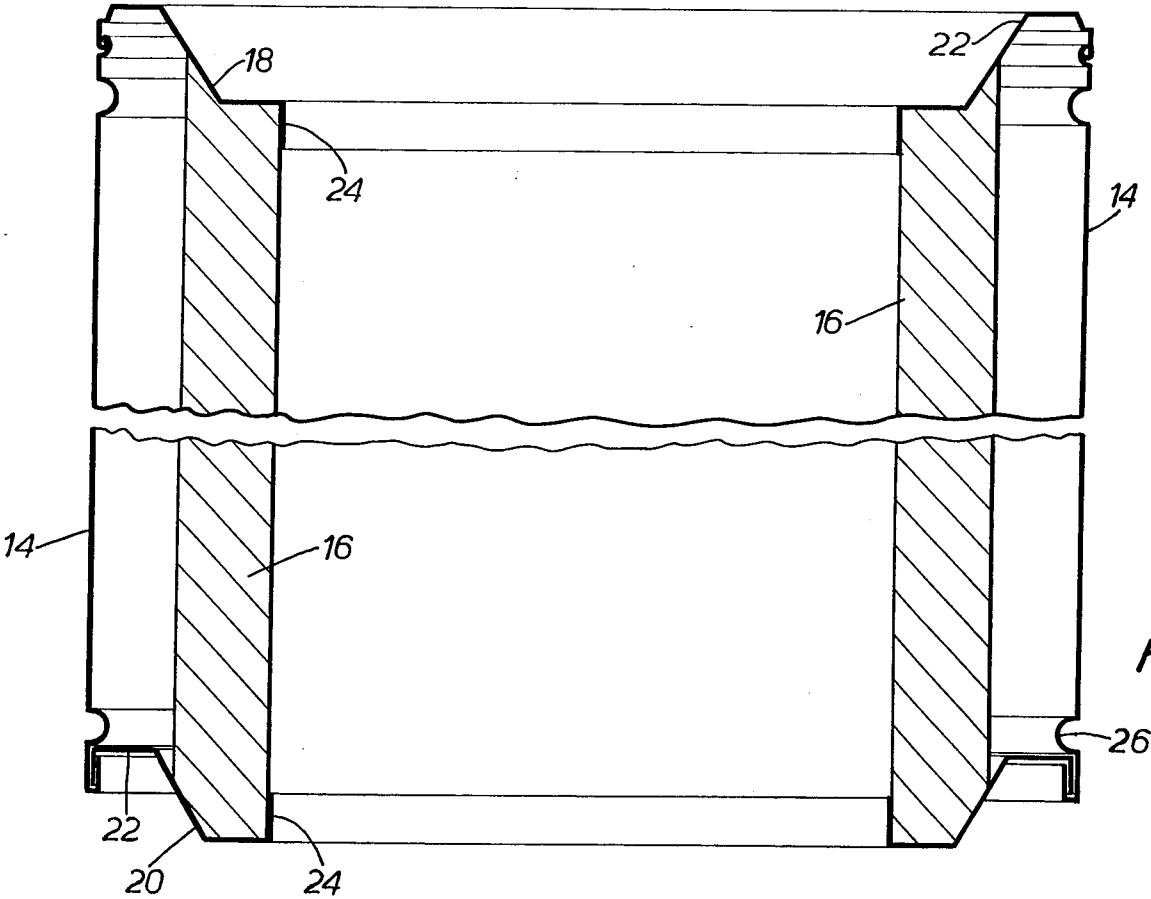
FIG. 3 is a still further enlarged longitudinal section through the chimney section shown in FIG. 2.

FIGS. 2 and 3 show a typical chimney section 4 which comprises an outer wall 14 of galvanised steel about 0.5 mm thick coaxially disposed within which is an inner wall 16 of bonded alumino-silicate fibres. The internal diameter of the chimney is between 12 and 20 cms, and the thickness of the inner wall and the thickness of the air gap between the inner and outer walls are both about 20 mm.

The inner wall composition is 34.5% alumina and 64.7% silica, with the balance being inorganic impurities such as oxides of iron, sodium and boron. The wall is formed of alumino-silicate fibres as described above and has a maximum continuous working temperature of 1260° C. Its melting temperature is 1760° C. and its density is 240 $Kg/m^3$. This working temperature should be adequate for most purposes, but if desired more alumina may be used, in which case the maximum working temperature may be increased to 1600° C.

As best seen in FIG. 3, the inner wall 16 is provided at its upper end with an internal 45° bevel 18 to form a female end and a complementary external 45° bevel 20 at its lower end to form a male end. At each end the chimney section is provided with a stainless steel end cap 22 which has a lip 24 which extends a short distance along the inner surface of the inner wall, a portion which lies against the bevelled sections 18 and 20 and is crimped to the outer wall to secure it to the inner wall. The two end caps have complementary formations, such as short screw threads (not shown) to enable adjacent sections to be connected together. The connection is then completed by a jubilee clip which passes around the joint in the conventional manner and which engages in the two peripheral grooves 26 formed in the outer wall.

Figure 4:
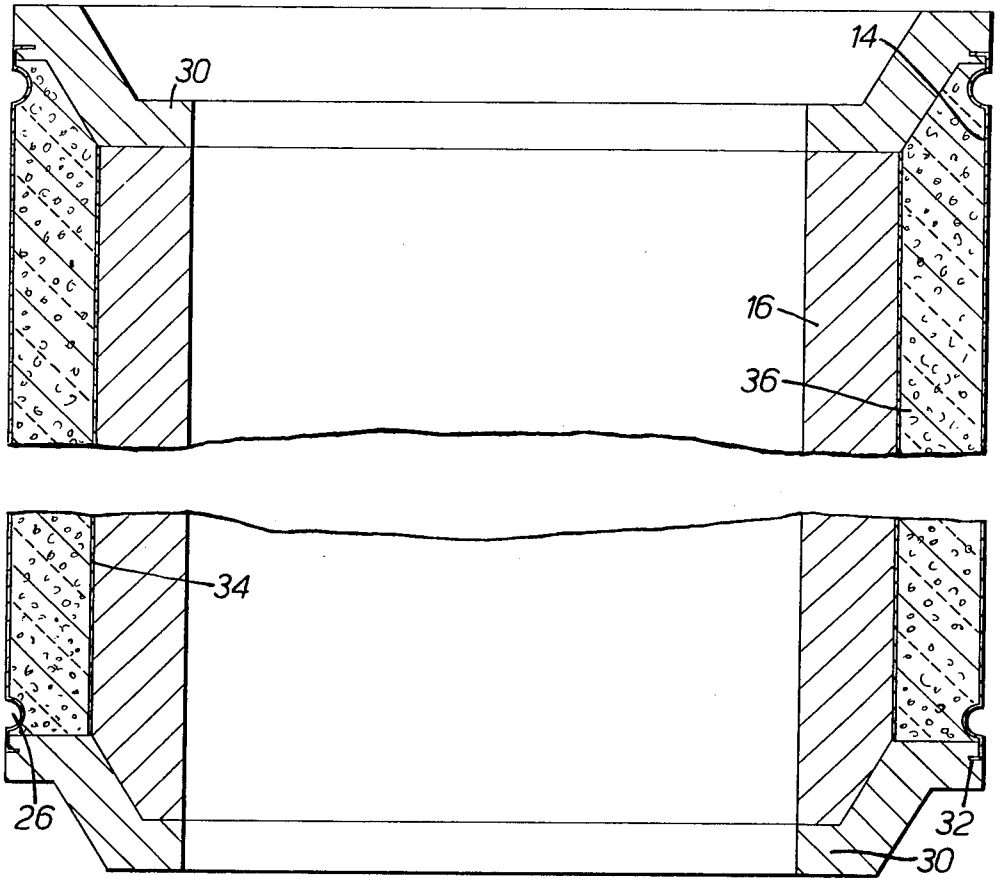
FIG. 4 is a view similar to FIG. 3 of a modified embodiment.

FIG. 4 shows a modified embodiment and the same reference numerals are used to designate similar items. The metallic end caps 22 are replaced by 40 board end caps 30 of bonded alumino silicate fibres. These have a shape which corresponds to that of the metallic end caps and may be moulded integrally with the inner wall 16 of the chimney or, as in this embodiment, are moulded and then subsequently bonded to it. The outer metallic wall 14 is connected to these end caps 30 by bonding or by crimping or otherwise deforming it over or into the end caps as at 32. This construction has the advantage that heat loss to the exterior is still further reduced since the metallic conductive path constituted by the end caps is replaced by low conducitivity ceramic fibres. In addition the one component which is possibly subject to corrosion is replaced by a corrosion free component. Ceramic fibre end caps are not suitable for having a screw thread formed in them, so adjacent chimney sections are merely connected to the jubilee clip or a toggle clip.

In addition, the outer surface of the inner wall 16 is covered by a galvanised steel liner 34. This liner facilitates the moulding of the inner wall and gives the finished wall greater mechanical strength. The gap between the inner and outer walls is filled with insulating material, in this case an aluminosilicate fibre blanket 36, to further increase the thermal insulation property of the chimney. The interior surface of the ceramic fibre inner wall may be relatively soft, and this can be disadvantageous under certain circumstances, e.g. if it is desired to sweep the chimney. In one embodiment of the invention the interior surface of the inner wall is coated, e.g. by spraying, with a heat resistant substance, based for example on silica, which improves its heat and abrasion resistance. It will be appreciated that these three later features may also be applied to the embodiment described with reference to FIGS. 1 to 3 above.

What I claim as my invention and seek to secure by Letters Patent is:

1. A domestic insulated chimney pipe section for use with domestic boilers, open fires or the like, said chimney pipe section comprising an inner one-piece tubular refractory liner consisting of vacuum formed inorganically bonded aluminosilicate fibers having a density of between 100 and 600 $kg/m^3$, and zero effective coefficient of thermal expansion, said inner liner being exposed in use to hot and corrosive gases passing through said pipe, an outer structural metallic wall member spaced from said inner liner, and two end caps one at each end of said inner liner and outer wall member, the said two end caps supporting and maintaining the said inner liner in a spaced relationship to said outer wall member so as to define therebetween an annular insulating dead air space, whereby the said inner liner and outer wall member and two end caps provide a rigid and lightweight insulated chimney pipe section, the outer wall member being protected from the heat and corrosive effects of the said gases by means of the said inner liner and its spaced relationship therefrom.

2. A chimney pipe section as claimed in claim 1 wherein said annular insulating dead air space additionally contains a fibrous insulating material.

3. A chimney pipe as claimed in claim 1 wherein said end caps are of male and female configuration respectively for mating with complementary end caps of adjacent sections.

4. A chimney pipe as claimed in claim 1 wherein said end caps are formed of metal.

5. A chimney pipe as claimed in claim 1 wherein said end caps are formed of aluminosilicate fibres.

6. A chimney pipe as claimed in claim 1 wherein said inner liner and outer wall members are separated by a gap whose width is between 6 and 30 mm.

7. A chimney pipe as claimed in claim 1 wherein said inner liner has a thickness of between 6 and 30 mm.

8. A chimney pipe as claimed in claim 1 wherein said inner liner has an interior surface, said interior surface being coated with a substance which improves its abrasion resistance.

* * * * *